United States Patent [19]

Pfeilsticker

[11] 3,953,937

[45] May 4, 1976

[54] PART ASSEMBLY FOR TOY VEHICLES

[75] Inventor: Lee J. Pfeilsticker, Long Lake, Minn.

[73] Assignee: Tonka Corporation, Hopkins, Minn.

[22] Filed: Dec. 9, 1974

[21] Appl. No.: 530,941

[52] U.S. Cl. ..... 46/221

[51] Int. Cl.[2] ..... A63H 17/26

[58] Field of Search ..... 46/221, 222, 223, 201, 46/218, 17

[56] References Cited

UNITED STATES PATENTS

| | | | |
|---|---|---|---|
| 653,514 | 7/1900 | Kasschau | 46/17 |
| 2,311,123 | 2/1943 | Osborne | 46/17 |
| 2,916,851 | 12/1959 | Groschen | 46/221 |
| 3,046,696 | 7/1962 | Zion | 46/17 |
| 3,107,453 | 10/1963 | Balthayor | 46/221 |

*Primary Examiner*—Louis G. Mancene
*Assistant Examiner*—Jack Q. Lever
*Attorney, Agent, or Firm*—Douglas L. Carlsen

[57] ABSTRACT

A panel for a toy vehicle truck box or the like wherein one edge of the panel interlocks with one wall of the box against outward removal therefrom and the opposing edge of the panel has an apertured tab adapted to be secured by a fastener such as a rivet to the wall of the box opposing said one wall.

1 Claim, 5 Drawing Figures

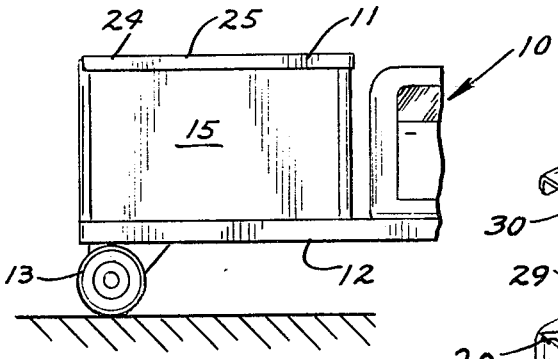
FIG. 1
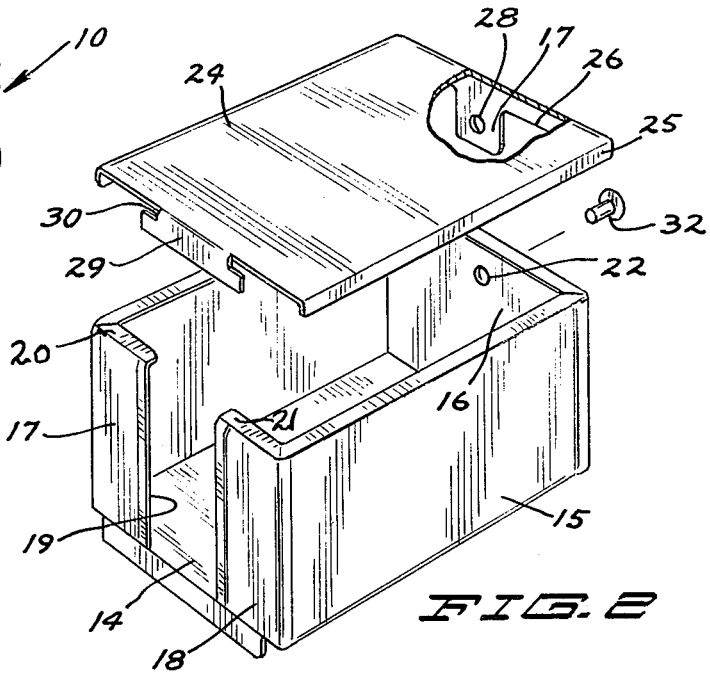
FIG. 2
FIG. 3
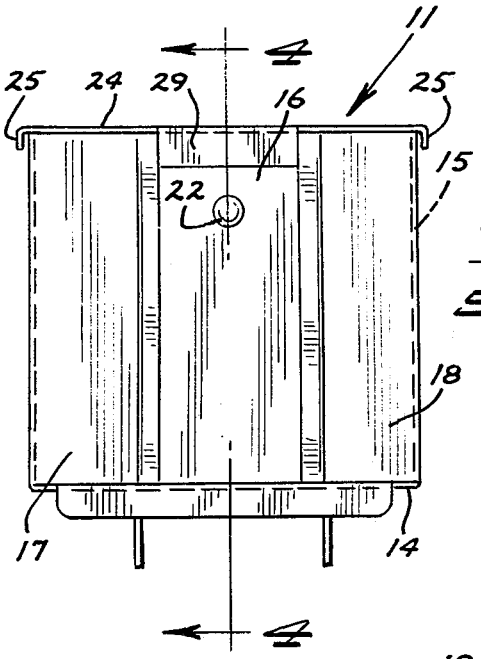
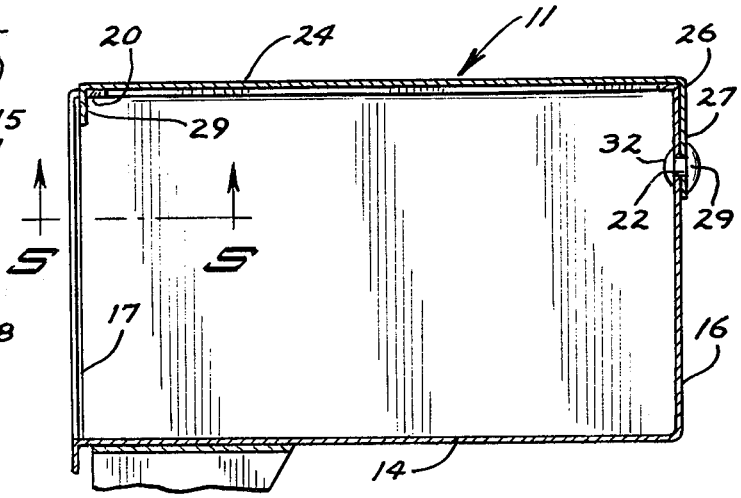
FIG. 4
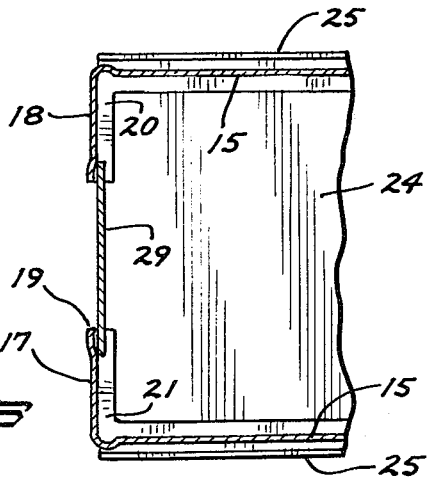
FIG. 5

PART ASSEMBLY FOR TOY VEHICLES

This invention relates generally to the construction of miniature toy vehicles and more particularly concerns the means of connecting one part such as a panel to other parts of the vehicle.

In the manufacture of toys in the relatively low price range the cost of production is extremely important to the manufacturer. The saving of pennies in the manufacture of a small toy can amount to many thousands of dollars in the overall picture. Such savings can, of course, occur both in the saving of materials and labor.

As indicated above, this invention relates to the connection of parts in toy vehicles. More particularly the invention relates to the mounting of a panel such as the roof on the top of a truck box such as used on a miniature toy moving van or the like.

Generally, in miniature toy vehicle construction any elongated part is immovably mounted on a mating part by welding or fastening at longitudinally spaced points necessitating two or more independent steps in the assembly operation.

A primary object of the present invention is to provide a new construction for miniature toy vehicle parts wherein two parts may be immovably secured together by a simple one-step rivet.

A more specific object of the invention is to provide a new and improved means for mounting a panel such as a roof on a miniature toy truck box.

With these and other objects in view the invention broadly comprises a first miniature toy vehicle part having spaced parallel walls with one of said walls having an edge flange directed toward the other wall and said other wall having an aperture and a second miniature toy vehicle part having parallel end edges with one of said edges having a hook extending under the flange on the said one wall and the other of said edges having a tab with an aperture adapted to align with the aperture in said other wall and a fastener extending through said apertures to secure the tab to said other wall.

BRIEF DESCRIPTION OF THE DRAWING

In the drawing:

FIG. 1 is a side elevation of the rear portion of a toy truck having a truck box embodying the present invention.

FIG. 2 is an exploded perspective view of the toy truck box prior to assembly.

FIG. 3 is a rear view of the box in assembled condition.

FIG. 4 is a longitudinal vertical section through the box taken along line 4—4 in FIG. 3.

FIG. 5 is a fragmentary section of the upper rear portion of the box taken along line 5—5 of FIG. 4 and looking upwardly.

DESCRIPTION OF THE PREFERRED EMBODIMENT

Referring now more particularly to the drawings reference numerals will be used to denote like parts or structural features in the different views. The numeral 10 denotes generally a miniature toy truck having a body member in the form of a box 11 mounted on a bed

12 supported on rear truck wheels 13. Box 11 has a bottom 14, a pair of side walls 15 and a front wall 16. The front wall 16 interconnects the side walls 15 and all of said walls are of equal height. The rear wall of the box 11 has two coplanar sections 17 and 18 having lips 20 and 21 extending forwardly from the upper edges thereof. The front wall 16 of box 11 has an aperture 22 in the upper portion thereof transversely centered between the side walls 15.

The top or covering panel for the box 11 is rectangular and denoted generally by the number 24. It has flanges 25 extending along its side edges which extend along the outer sides of the upper portions of side walls 15 and a flange 26 which fits against the outer side of front wall 16 when the cover is mounted on the box. The flange 26 has a tab 27 which projects downwardly therefrom and which has an aperture 28 which aligns with the aperture 22 in wall 16.

Along its rear edge the panel 24 has a centrally located hook flange 29 which is somewhat wider than the space 19. Notches 30 are provided at opposite ends of the flange 29 to receive the lips 20 and 21 on sections 17 and 18.

In the manufacture of box 11 the bottom 14, side walls 15, front wall 16 and rear wall sections 17 and 18 are formed from a single piece of sheet metal material. The top panel 24 is then mounted by sliding it rearwardly onto the box with flange 29 moving into flush contact with sections 17 and 18 and notches 30 receiving the lips 20 and 21. This locks the rear end of panel 24 on the box. A rivet 32 is then inserted through the aligned apertures 22 and 28 and the end thereof inside of the box is flattened to secure it in place. This permanently locks the member 24 to the box 11. Opening 19 provides the access to the rivet 32.

The construction accordingly provides an efficient, economical, and durable means of assembling miniature toy vehicle parts. Having now therefore fully illustrated and described the invention, what I claim to be new and desire to protect by U.S. Letters Patent is:

1. In a truck box for miniature toy vehicles, a. a box having a bottom and parallel side walls and front and rear parallel end walls extending upwardly equidistant from the bottom, b. the rear end wall being formed of two coplanar sections spaced apart laterally and said sections having flanges along their upper edges extending toward the front wall, c. a rectangular top panel for covering the box having depending flanges along its side edges for engaging against said side walls and a tab extending downwardly from the front edge thereof to engage against the front end wall of the box, d. a hook flange depending from the central portion of the rear edge of the panel with the end portions thereof extending laterally in spaced relation to the panel under the flanges on said sections to lock the rear edge of the panel to the box, e. the said tab and front end wall of the box having aligned apertures, and f. a rivet extending through said apertures to lock the front edge of the panel to the box.

* * * * *